United States Patent [19]

Dragagna et al.

[11] Patent Number: 4,493,131

[45] Date of Patent: Jan. 15, 1985

[54] CONTROL DEVICE FOR OPENING FIBER BALES

[75] Inventors: Claudio Dragagna, Pavia; Claudio Locatelli, Capriolo, both of Italy

[73] Assignee: Fratelli Marzoli & C. S.P.A., Palazzolo Sull'Oglio, Italy

[21] Appl. No.: 447,685

[22] Filed: Dec. 7, 1982

[30] Foreign Application Priority Data

Dec. 11, 1981 [IT] Italy ..... 25554 A/81

[51] Int. Cl.[3] ..... D01G 13/00

[52] U.S. Cl. ..... 19/80 R; 19/81; 19/145.5

[58] Field of Search ..... 19/80 R, 81, 145.5

[56] References Cited

U.S. PATENT DOCUMENTS 4,107,820 8/1978 Mahrt et al. ..... 19/145.5 X
4,281,437 8/1981 Marx ..... 19/80 R
4,297,766 11/1981 Trutzschler ..... 19/80 R
4,297,767 11/1981 Leifeld ..... 19/80 R
4,382,316 5/1983 Goldammer ..... 19/145.5 X

*Primary Examiner*—Louis K. Rimrodt
*Attorney, Agent, or Firm*—Holman & Stern

[57] ABSTRACT

A machine for withdrawing or removing fibre staples from a set of bales of textile staples which can be displaced rectilinearly and alternately, with a carriage having a reciprocal vertical motion carrying rotary reels for removing said fibre staples from the bales is controlled by a device which comprises a plurality of detectors adapted previously to determine in the vertical sense sequential working zones for the carriage on the bales and an apparatus for automatically impressing a differential action of the carriage on the bales in relationship with the sequential preselected working areas. Thus the withdrawal of the fibre staples is obtained consistently with the compactness of the material contained in the bales without discrepancies in the production run and with a constant degree of bale-breaking.

3 Claims, 1 Drawing Figure

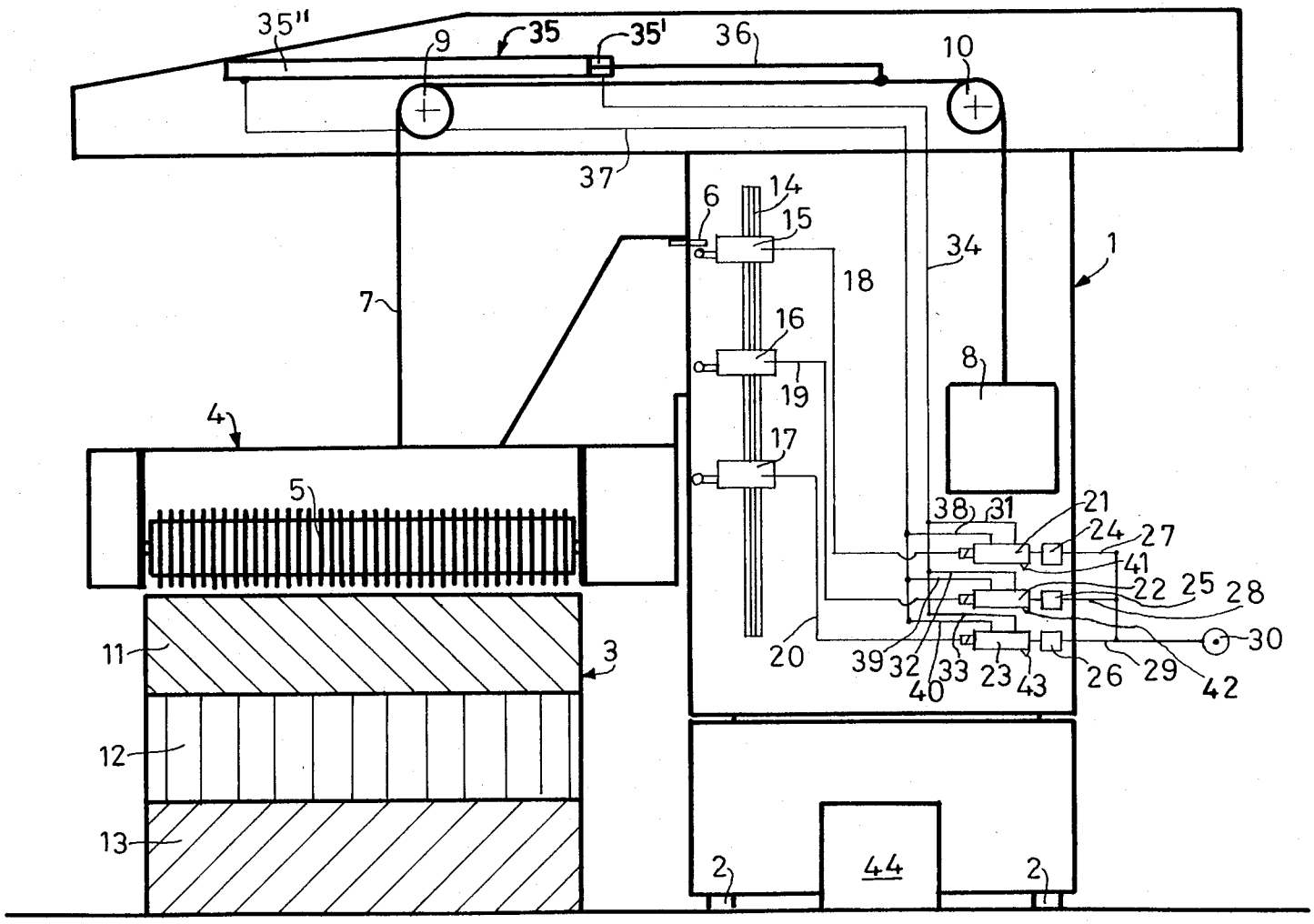
1
2
2
3
4
5
6
7
8
9
10
11
12
13
14
15
16
17
18
19
20
21
22
23
24
25
26
27
28
29
30
31
32
33
34
35
35'
35''
36
37
38
39
40
41
42
43
44

CONTROL DEVICE FOR OPENING FIBER BALES

This invention relates to a control device for a machine for withdrawing or removing fibre staples from a set of staple bales of textile fibres.

Withdrawing machines are known, to which a reciprocal motion is imparted and which have breaking and automatic withdrawing mechanisms for removing fibre staples from textile staple bales, which essentially consist of revolving reels mounted on a carriage which has a vertical reciprocation movement and which remove, from the bale tops, the fibre staples, these latter being subsequently conveyed to subsequent processing steps pneumatically.

The shift of the movable carriage for removing the fibre staples from the bales is carried out by mechanical and electromechanical devices having a predetermined increment since the very start of the processing run, or by pneumatical control mechanisms which impress onto the bales a pressure which is preselected since the start of the processing run, said pressure being kept constant up to the end of the process.

Such control devices have the main defect that a non constant quantity of staples is withdrawn from the bales during the processing run, so that variations in the production are experienced.

Such variations in the production is originated by the different density of the staple material contained in the bales, and, more accurately, by lower densities in the peripheral bale areas as compared with higher densities in the innermost bale areas. The variation in the production entails, moreover, the withdrawal of the material with different degrees of breaking in the fibre staples so that the quality of the end product is consequentially at a variance.

Thus, the object of the present invention is to provide a control device for a machine for removing fibre staples from a set of staple bales, which automatically permits the previous selection of the quantity of the material to be removed, with the same degree of breaking of the staple in the different processing areas of the bales concerned consistently with the compactness of the bale material, and which is exempt from the drawbacks aforementioned.

This object is achieved, according to the present invention, by a control device for a machine for removing staples from staple bales equipped with a reciprocal motion on staple bales of textile fibres, and equipped with rotary reels mounted on a carriage having a vertical reciprocal motion and which remove, from the bale tops, fibre staples which are pneumatically forwarded to subsequent processing steps, characterized in that it comprises a plurality of detectors capable of determining beforehand in the vertical sense sequential processing areas of the movable carriage on the bales and an apparatus for automatically impressing a differential action of said carriage on said bales, consistently with the sequentially arranged and preselected processing areas.

The detectors may consist of microswitches mounted on the machine and level-adjustable.

The apparatus for automatically determining the differential action of the carriage on the staple bales may consist, for example, of a plurality of electromagnetic valves and pressure regulators, corresponding to the number of the detectors and which, through pipelines, introduce air under different pressures into a pneumatic ram which controls the lifting or the depression of the carriage which carries the reels relative to the staple bales.

Further characteristics and advantages will become more clearly apparent from the disclosure of an exemplary embodiment which is shown by way of illustration only and is not a limitation, on the accompanying drawing, the single FIGURE of which diagrammatically shows a front view of the control device according to the invention as applied to a machine for withdrawing fibre staples.

In the drawings a conventional withdrawing machine 1 is shown, which, by means of wheels 2, can be rectilinearly and horizontally reciprocated along the staple bales 3 (only one is shown) placed in aligned relationship according to an arrangement which is quite conventional as such. Above the bales 3 the carriage 4 is positioned which is reciprocable in a vertical direction and comprises at least a rotary bale opening reel 5, a rod 6 and members for controlling the rotation of the reel 5 in the conventional way so that such members have not been shown because they are not a part of the invention. The carriage 4 is connected, by means of a strap 7 to a counterweight 8 to balance the carriage weight, the strap 7 being reciprocable over two pulleys 9 and 10.

The textile fibre staple bales 3, for convenience of illustration, have been vertically split into three sequentially arranged superimposed zones 11, 12 and 13, having different compactnesses and, consistently with the height of such zones, three detectors 15, 16 and 17 are adjustably positioned spaced from one another on the machine 1 by means of a guideway 14: the detectors, which are in the form of microswitches, are electrically connected by leads such as 18, 19 and 20 to three electromagnetic valves 21, 22 and 23. These electromagnetic valves are connected, via respective pressure regulators 24, 25 and 26 set at different pressures P1, P2 and P3, respectively, and also via pipings 27, 28 and 29, to a source 30 of compressed air.

The three electromagnetic valves 21, 22 and 23 can feed with compressed air, via the pipings 31, 32, 33 and 34, a pneumatic ram 35: the latter is connected, via the stem 36 of its piston, to the strap 7 such as to control the vertical position of the carriage 4, whereas the air outlet of the ram 35 is composed of the pipings 37, 38, 39 and 40 and the openings 41 42 and 43 placed on the electromagnetic valves 21, 22 and 23.

The operation of the control device made according to the invention is as follows.

As the processing run is started, the carriage 4 of the staple stripping machine 1, equipped with the rotary withdrawing reel arrangement 5, rests upon the first layer 11, of the staple bales 3 and, concurrently, via the rod 6 rigid with the carriage 4, is active upon the detector 15 which had previously been positioned on the guideway 14.

Meanwhile, the compressed air from the source 30 is distributed, via the pipings 27, 28 and 29, to the three pressure regulators 24, 25 and 26 which are connected to the three electromagnetic valves 21, 22 and 23, respectively, so as to supply air under three different pressure magnitudes, P1, P2 and P3, respectively. The detector 15, via the lead 18, energizes the electromagnetic valve 21 to open same (whereas the remaining two electromagnetic valves 22 and 23 are closed) so that, via the pipings 31 and 34, air is fed under the pressure of magnitude P1 (as produced by the pressure regulator 24) to the compartment 35' of the pneumatic ram 35. Air is vented from the chamber 35″ via the pipes 37 and 38 as well as via the outlet port 41 of the electromagnetic valve 21. The air under such a pressure P1 entering the chamber 35′ shifts the piston stem 36 in the ram 35 and the latter, connected to the strap 7, causes the carriage 4 to press, with a pressural force equal to P1, the layer 11 of the bales 3 so that the reel 5, being rotated, withdraws the material from the layer 11 in the form of fibre staples consistently with said pressure P1. The fibre staples, via conduits which are not shown in the drawing, are pneumatically forwarded to a collecting channel 44 to be sent to subsequent processing steps.

It should be noted that the machine 1 is rectilinearly shifted with the wheels 2 with reciprocations on a set of staple bales 3 and, after a number of passes the layers 11 of all the bales concerned are removed so that the rod 6 of the carriage 4 becomes active upon the detector 16 which had previously been positioned at a certain distance apart from the detector 15, said distance being the thickness of the first layer 11 of the staple bales 3. During the entire vertical displacement of the carriage 4 corresponding to the distance between the two detectors 15 and 16, the carriage pressed with the pressure of magnitude P1 onto the bales 3. The detector 16, via the lead 19, closes the electromagnetic valve 21 and, simultaneously, opens the electromagnetic valve 22: the latter, via the pipings 32 and 34, feeds with air compressed under the pressure P2, the magnitude of which is adjusted by the pressure regulator 25, the chamber 35′ of the pneumatic ram 35. The air contained in the chamber 35″ is now vented via the pipes 37, 39 and the outlet 42 of the electromagnetic valve 22.

The air which has been fed to the chamber 35′ under the pressure P2 shifts the stem 36 and consequently the carriage 4 pressed onto the layers 12 of the bales 3 with a pressure equal to P2 so that the rotary reel 5 strips the material in conformance with a pressure P2 which is different from the pressure P1.

After having removed all the material of the bale 3 layers 12 the carriage 4 has dropped and presses by the rod 6 and detector 17 which, via the lead 20, actuates the closure of the electromagnetic valve 22 while concurrently opening the electromagnetic valve 23: the latter, via the conduits 33 and 34, feeds air under the pressure of magnitude P3, as governed by the pressure regulator 26, the chamber 35′ of the ram 35, whereas the air which is held in the chamber 35″ is discharged via the pipes 37 and 40 and the outlet passage 43 of the electromagnetic valve 23. The air having the pressure P3 shifts the stem 36 so that the carriage 4 becomes active upon the layer 13 with a pressure P3 so that the rotary reel 5 removes fibre staples consistently with a pressure of P3.

The advantages achieved by the control device according to this invention are as follows.

The withdrawal of the fibre staple material from the staple bales is carried out consistently with the compactness of the bale material so that there are no variations in the production.

The material which is removed from each layer of different compactness has always the same degree of bale-breaking so that the quality of the end product is consequentially improved.

Apparently, the partition into superposedly arranged layers of the textile staple bales can be made beforehand according to the type of fibre concerned, their origin and so forth, and it is possible to determine, at the outset, more than the three layers shown by way of example in the present disclosure. The preselected number of layers having different degrees of compactness must correspond, of necessity, to the number of detectors to be positioned on the guideway 14, the mutual distances between said detectors corresponding to the thicknesses of the several layers of staple material.

If the movable carriage of the bale-breaking machine is controlled in its vertical motion by means other than the pneumatical ones, also the apparatus intended to impart the differential action of the carriage onto the staple bales shall be of a different nature. Thus, for example, if the carriage shift control is of an electromechanical type, the apparatus in question will contain speed-change gears electrically actuatable by the detectors.

We claim:

1. A device for controlling a machine for removing fibre staples from a set of staple bales of textile material, wherein the machine is horizontally reciprocable along said bale set and comprises a carriage reciprocable in a vertical direction and having a rotary bale opening reel arrangement to strip from said bales fibre staples to be pneumatically conveyed to subsequent processing steps, and wherein the device comprises a plurality of detectors spaced from one another in a vertical direction according to superimposed zones of said bales having sufficient compactness, means for actuating said detectors in response to vertical movement of said carriage, and means controlled by said detectors to cause said carriage and rotary bale opening reel arrangement to exert on said bales pressures of different magnitudes according to said zones of different compactness.

2. The device according to claim 1, wherein said detectors are arranged on the machine and comprise level-adjustable microswitches and said means for actuating said detectors comprise a rod rigidly carried by said carriage.

3. The device according to claim 1, wherein said means controlled by said detectors comprise a plurality of electromagnetic valves and relative pressure regulators each associated to a respective one of said detectors, and a pneumatic ram having a piston stem for controlling the vertical position of said carriage, said electromagnetic valves being selectively operable to supply compressed air into said ram with different pressure magnitudes to cause different pressure actions of said carriage onto said bales.

* * * * *